United States Patent [19]

Hanson

[11] 4,085,539

[45] Apr. 25, 1978

[54] PLATFORM TOY

[75] Inventor: Steven P. Hanson, Bloomington, Minn.

[73] Assignee: Reynolds W. Guyer, St. Paul, Minn.

[21] Appl. No.: 736,265

[22] Filed: Oct. 27, 1976

[51] Int. Cl.[2] ..... A63H 33/00

[52] U.S. Cl. ..... 46/1 C; 273/86 E

[58] Field of Search ..... 46/1 C, 40, 137; 273/86 E, 86 D, 85 R, 85 F

[56] References Cited

U.S. PATENT DOCUMENTS

| | | | |
|---|---|---|---|
| 539,807 | 5/1845 | Goodwin | 46/127 |
| 1,714,749 | 5/1929 | Zoobley | 273/86 E |
| 1,755,621 | 4/1930 | Whitehouse | 273/86 E |
| 1,922,802 | 8/1933 | Gueydan | 273/86 E |
| 1,951,051 | 3/1934 | Gueydan | 273/86 E |
| 2,167,985 | 8/1939 | Levay | 273/86 E |
| 2,808,265 | 10/1957 | Amico | 273/86 E |
| 2,861,807 | 11/1958 | Dormoy | 273/86 |
| 3,698,713 | 10/1972 | Jimerson | 273/86 E |
| 3,735,984 | 5/1973 | Asano | 273/86 E |
| 3,769,743 | 11/1973 | Benkoe et al. | 46/1 C |
| 3,792,548 | 2/1974 | Hamano | 46/1 C |

FOREIGN PATENT DOCUMENTS

| | | | |
|---|---|---|---|
| 408,909 | 10/1909 | France | 273/86 E |

*Primary Examiner*—Russell R. Kinsey

*Assistant Examiner*—Mickey Yu

*Attorney, Agent, or Firm*—Frederick E. Lange

[57] ABSTRACT

An action toy having a platform with a resilient sheet member providing a playing surface of the upper side, the sheet member being supported so as to leave a space beneath it, and a manually operated, elongated leaf spring mounted so as to extend partially beyond the platform and partially within the platform underneath the sheet member in such a position as to intermittently engage the under side of the sheet member when the resilient strip is vibrated. The strip is mounted in the platform in such a manner that when the outer portion is vibrated by engaging and then suddenly releasing the outer end, the vibration is transmitted to the inner portion to cause the inner end to intermittently engage the under side of the sheet member. The playing pieces placed on the playing surface are designed for movement therealong when the playing surface is vibrated. For example, the playing pieces may have resilient feet inclined upwardly in the direction of the desired movement. The elongated strip preferably has about two-thirds of its length outside of the platform and one-third in. It is mounted in a slot on the edge of the platform wall with sufficient vertical play to allow the vibration of the outer portion to be transmitted to the inner portion.

10 Claims, 2 Drawing Figures

PLATFORM TOY

BACKGROUND OF THE INVENTION

It has been proposed to provide a game in which a motor operated means is provided for causing a playing surface to be vertically vibrated so that movable playing pieces placed on the playing surface tend to move along the playing surface. In some cases, this has been accomplished by designing the movable playing pieces so that they tend to move in one direction when vibrated. Such toys, while very entertaining, have the drawback that they must of necessity be somewhat expensive and require some source of power such as a battery or means for connection to a commercial source of power.

While mechanical arrangements have been devised for causing reciprocation of a playing surface, prior art devices are for the most part not concerned with imparting a vibratory movement to a playing surface parallel to the plane of the playing surface. Furthermore, some of them are quite complicated, involving crank operated devices.

SUMMARY OF THE PRESENT INVENTION

The present invention is concerned with an action toy of the type employing a playing surface which can be vertically vibrated in which the vibration is imparted to the playing surface by a resilient member having a portion extending beneath the playing surface in a position to intermittently engage the same and having an outer portion adapted to be displaced and then suddenly released. The vibration imparted to the outer portion is transmitted to the inner portion to cause vibration of the surface. The arrangement thus provides an extremely simple arrangement for causing vibration of a playing surface.

The present invention is concerned with such an action toy in which the vibrating resilient element is loosely mounted in the side wall of the platform so that the vibrations of the outer portion are readily transmitted to the inner portion.

The elongated resilient member is preferably in the form of a flat strip which extends through a flat horizontal slot in the edge wall of the platform and is held against longitudinal movement with respect thereto. One way in which the strip is held is to provide a block on the inner side wall through which the elongated strip extends and in which it is held against longitudinal movement by a pin extending through the block and through the strip generally transverse to the longitudinal axis of the strip.

The resilient strip is preferably provided at its outer end with a finger piece designed for engagement by and ready release by a finger of the player to permit sudden release of the strip to cause it to vibrate.

The playing piece which is used is one which is designed to move when vibrated. For example, the playing piece may be provided with resilient feet inclined upwardly in the desired direction of movement of the piece.

To facilitate vibration of the playing surface, the strip is preferably provided with a mass secured to its inner end, the mass being disposed so as to lie close to the under surface of the sheet member. Various other objects and features of the present invention will be apparent from a consideration of the accompanying specification, claims and drawing.

DESCRIPTION OF THE PREFERRED EMBODIMENT

Figures 1, 2:
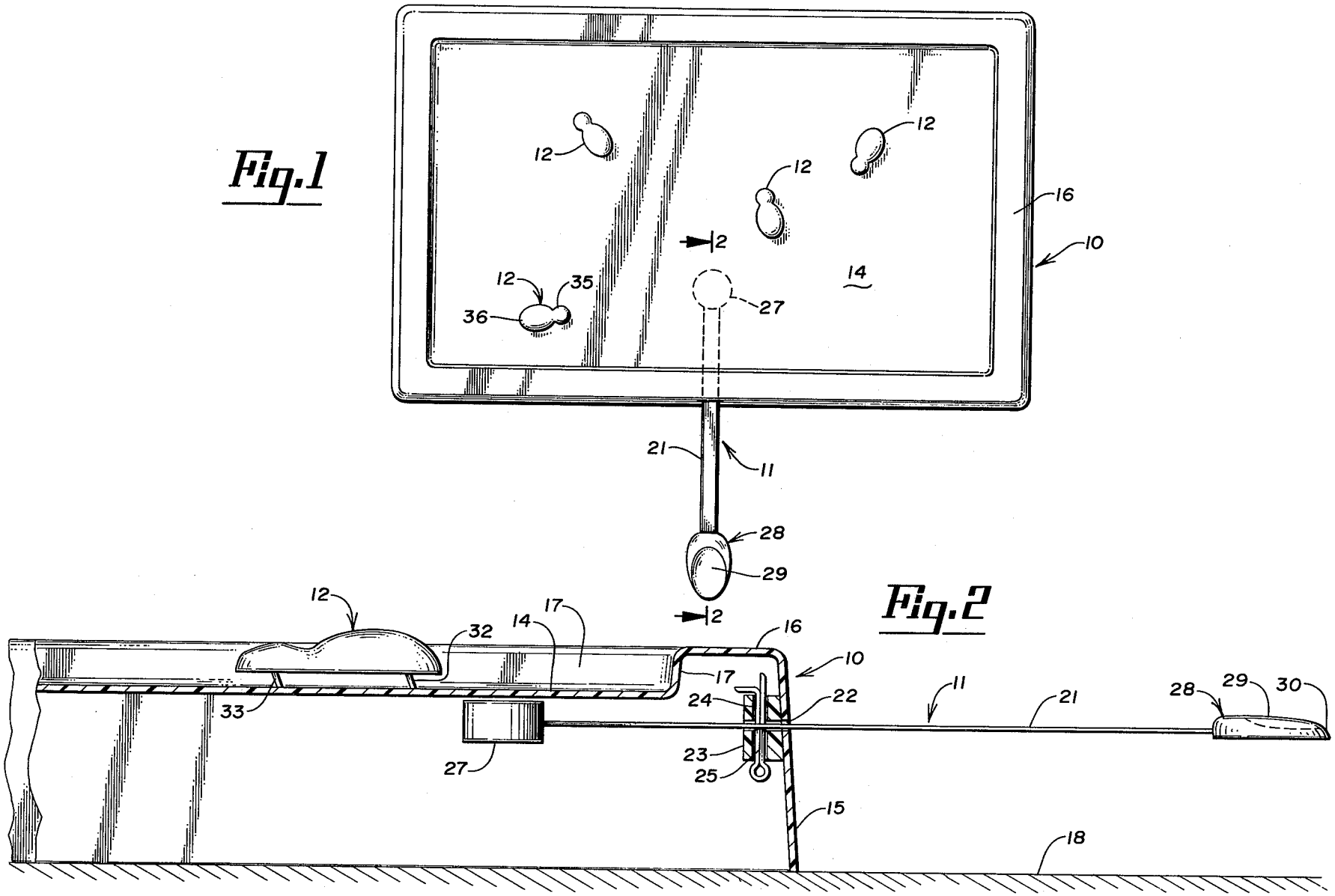
FIG. 1 is a plan view of my improved action toy and FIG. 2 is a section on a much larger scale of a portion of the toy, the section being taken along the line 2—2 of FIG. 1.

Referring to FIG. 1, the action toy comprises a platform generally indicated by the reference numeral 10, vibrating apparatus 11 associated with the platform, and a plurality of playing pieces 12 which are normally placed upon the playing surface provided by the platform. Referring to the platform 10, this comprises a resilient sheet member 14. The sheet member is formed of a suitable plastic or other material having the desired resilience. In one particular instance, sheet material having a thickness of 0.04 to 0.06 inches was employed. The sheet material should be so designed that upon an impact being imparted thereto, the sheet tends to vibrate vertically. The upper surface of sheet member 14 provides a playing surface. While this playing surface is shown as flat in the illustration, it is of course to be understood that in some cases, it can be formed to provide obstructions or representations of objects associated in some manner or other with the playing pieces. Sheet member 14 is supported by an outer wall 15 which extends around the periphery of the platform and supports the sheet member 14 a desired distance above a suitable support 18 upon which the platform is placed and upon which the toy is to be played. The outer wall 15 is connected at its upper end with a horizontal flange portion 16 which connects through a generally vertical wall portion 17 with the sheet member 14. The wall portion 17 acts to form a boundary for the playing surface and form a wall to prevent the playing pieces 12 from being manipulated off of the edge of the sheet member 14.

The present invention is particularly concerned with the means for causing vertical vibration of the sheet member 14. As previously indicated, this vibrating mechanism is generally indicated by the reference numeral 11. The vibrating mechanism 11 includes a long resilient strip 21 of resilient material such as spring steel. The strip 21 extends through a slot 22 in the side wall 15. Secured to the side wall 15 is a block 23 which has a slot therethrough aligned with slot 22 and also has a cylindrical opening 24. The strip 11 has an aperture provided therein and a cotter pin 25, or other similar fastening means, extends through the opening 24 and the opening in the strip 21 generally transversely of the longitudinal axis of the strip to hold it longitudinally in position. As will be evident from FIG. 2, the vertical depth of slot 22 and of the slot in block 23 aligned with slot 22 is substantially greater than the thickness of strip 21 so that the strip 21 is free to move up and down slightly within the block 23 and the slot 22. The significance of this will be discussed later.

At the inner end of the strip 21, a hammer block 27 is secured. This block 27 is shown as being of cylindrical cross section although other cross sectional configurations could be employed. The outer end of strip 21 has a finger piece 28 secured thereto. Finger piece 28 has a finger recess 29 into which the finger of a player is adapted to be placed. The outer edge 30 of the finger piece 28 is curved so as to enable the finger to slip off the end of the finger piece 28 rather readily.

In use, the finger piece 28 is normally depressed in the direction of the support 18 and then suddenly released by removal of the finger from the finger piece 28. One way in which this can be done is to slide the finger off of the outer end of the finger piece 28, this being facilitated by the curvature 30. When this happens, the outer end of the strip 21 vibrates up and down. It has been found that this in turn imparts repeated vibration to the inner portion of the spring 21, particularly when the width of the slot 22 and the width of the slot in block 23 aligned with slot 22 is sufficiently greater than the width of the strip 21 to permit a limited amount of vertical movement of the strip 21. In order to transmit the vibration of the outer portion of the strip 21 to the inner portion, not only is it necessary to have the play in the slot 22 and slot 24 as just described, but it is also desirable to have a predetermined relationship between the length of the portion of strip 21 outside of the platform 10 and that within. I have found that a desirable relationship is maintained when the portion within the housing beyond the cotter pin 25 is about one-third of the total length of the strip and that outside is about two-thirds. In other words, the portion outside of the platform 10 should be about twice as long as that within the platform 10. While various other ratios are possible, it has been found that this particular ratio works very effectively in enhancing the vibration of the inner portion of strip 21 that occurs and hence the vibration of the block 27.

While the block 27 is shown in FIG. 2 as spaced just below the bottom of sheet 14 in the rest position of the strip, the block 27 may actually engage the underside of the sheet member 14 due to the weight of the outer portion of the strip tilting the strip clockwise. In any event, the block member 27 is sufficiently close to the bottom sheet member 14, however, that upon vibration of the inner portion of the strip 21, the block member is repeatedly brought into engagement with the under side of the sheet member 14. The block 27 preferably has sufficient mass that when the strip 21 is vibrated in this manner, the block 27 imparts sufficient impact to the sheet member 14, each time that it hits it, to cause the sheet member 14 to vibrate vertically.

The playing pieces are preferably of a type which move on the playing surface provided by sheet member 14 whenever the sheet member 14 is vertically vibrated. It has been found that the movement of the playing pieces 12 in any given direction is facilitated if they are mounted on resilient feet which are slanted with respect to the vertical. Referring to FIG. 2, it will be noted that there are feet 32 and 33. It is to be understood that there are two pairs of such feet, only one of each pair being visible in the drawing. It will also be noted that these resilient feet 32 and 33 slant upwardly in a given direction which is the desired direction of movement of the playing piece. In other words, referring to FIG. 2, it will be noted that the resilient feet 32 and 33 slant upwardly towards the left. It will be appreciated that any vibration of the playing piece 12 tends to cause it to move to the left. This is partly because of the fact that movement to the rear would be against the action of the resilient feet 32 and 33. As shown in FIG. 1, the playing piece may be so shaped that the forward portion 35 resembles the head of an animal and the rear portion 36, the body of such an animal. The invention is in no way, however, limited to the particular shape of the playing piece. These playing pieces can take various configurations. For example, the playing surface provided by the sheet member 14 could take the form of a football field and the playing pieces 12 could simulate football players. One of the football players could be the ball carrier and that piece could move through the field until it was touched by another piece, as in touch football. The playing surface 14 could also be an elongated playing surface with the pieces initially in spaced position along this elongated surface and moved in such a manner as to simulate a relay race.

It will be obvious that the vibrating mechanism 11, unlike that employed in prior action toys, is extremely simple in nature and requires merely mechanical actuation to cause the same to vibrate the playing surface formed by sheet member 14. The vibrating mechanism can be formed very simply with a minimum of expense.

As pointed out above, it is possible to form the entire platform by a simple molding operation. For example, the platform may be vacuum formed. The assembly of the vibrating member 11 can be made very simple by providing for the insertion of the strip 21 through the slot 22 in the block 23 before one of the two end pieces 27 or 28 has been applied. After the strip 21 has been anchored in position by the insertion of the cotter pin and the bending over of the free end of the cotter pin, the end piece can then be fastened to the strip 21.

It will be appreciated that I have provided an extremely simple action toy providing for the vibration of a playing surface in which the vibrating action is provided by an extremely simple mechanism capable of being manually operated.

While I have shown a specific embodiment of my invention, it is to be understood that this is for purposes of illustration only and that the scope of my invention is to be limited solely scope of the appended claims.

I claim:

1. An action toy including:

a platform having a resilient sheet member providing a playing surface on the upper side thereof and means for supporting said sheet member from any suitable support with the under side of said sheet member spaced from said support, manually operated vibrating apparatus for vibrating said sheet member, said vibrating apparatus comprising an elongated resilient member mounted on said platform with its longitudinal axis extending generally in the same direction as said playing surface with a portion thereof extending inwardly beneath said sheet member and a portion projecting outwardly beyond said platform, the inner end of said inwardly extending portion and the outer end of said outwardly extending portion both being free to vibrate, said resilient member having an impact member adjacent the inner end thereof and positioned to intermittently engage the under side of said sheet member when said resilient member is vibrated and being designed adjacent its outer end for engagement by an extremity of a player so that upon pressure being applied to said outer end and suddenly removed, said outer portion vibrates, and means for securing said elongated resilient member to said platform in such a manner that when said outer portion of said resilient member is vibrated, the inner portion beneath said sheet member is repeatedly vibrated to cause said impact member repeatedly to engage the under side of said sheet member, and at least one playing piece designed for being placed upon said playing surface and for movement therealong when said playing surface is vibrated.

2. The action toy of claim 1 in which the means for supporting the sheet member includes a slotted side wall for said platform and in which said elongated resilient member extends through the slot in said side wall.

3. The action toy of claim 1 in which the portion of said elongated resilient member extending outwardly beyond said platform is approximately twice as long as the inner portion disposed beneath said sheet member.

4. The action toy of claim 1 in which the elongated resilient member is in the form of a flat narrow strip.

5. The action toy of claim 4 in which the means for supporting the sheet member includes a side wall having a horizontal slot therein and in which the flat resilient strip extends through said slot and is held against longitudinal movement with respect to said side wall.

6. The action toy of claim 5 in which said resilient strip loosely fits in said slot for limited vertical movement of said strip in said slot so as to facilitate transmission of the vibration of the outer portion of the strip to the inner portion.

7. The action toy of claim 5 in which a block is secured to the interior of said side wall with a slot therethrough in alignment with the slot in said side wall and in which a pin extends through said block and strip generally transversely to the plane of the strip to retain the strip against longitudinal movement with respect to the side wall.

8. The action toy of claim 1 in which the outer end of said elongated resilient member has secured thereto a finger piece designed for engagement by and ready release by a finger of a player.

9. The action toy of claim 1 in which the playing piece has resilient feet for supporting the playing piece on the playing surface, said resilient feet being inclined upwardly in the desired direction of movement.

10. The action toy of claim 1 in which the inner end of said elongated resilient member has a mass secured thereto and of such size that the upper surface thereof lies close to the under surface of said sheet member.

* * * * *